US005259753A

United States Patent [19]

Kobsa

[11] Patent Number: 5,259,753

[45] Date of Patent: Nov. 9, 1993

[54] SPINNERET CAPILLARIES

[75] Inventor: Henry Kobsa, Greenville, Del.

[73] Assignee: E. I. Du Pont de Nemours and Company, Wilmington, Del.

[21] Appl. No.: 606,659

[22] Filed: Oct. 31, 1990

Related U.S. Application Data

[63] Continuation-in-part of Ser. No. 430,944, Nov. 2, 1989, abandoned, which is a continuation-in-part of Ser. No. 273,069, Nov. 18, 1988, abandoned.

[51] Int. Cl.[5] ..... B29C 47/12

[52] U.S. Cl. ..... 425/461; 264/177.130; 425/192 S; 425/464

[58] Field of Search ..... 425/461, 464, 382.2, 425/192 S; 264/177.13, 177.14, 177.15, 177.16, 209.1

[56] References Cited

U.S. PATENT DOCUMENTS

| | | | |
|---|---|---|---|
| 2,341,555 | 2/1944 | Jones | 425/464 |
| 2,742,667 | 4/1956 | Colouzeau et al. | 425/464 |
| 2,839,783 | 6/1958 | De Wolf | 425/464 |
| 2,879,676 | 3/1959 | Burkhardt et al. | 425/461 |
| 2,907,687 | 10/1959 | Scigliano | 425/461 |
| 3,049,753 | 8/1962 | Ogden et al. | 425/464 |
| 3,210,451 | 10/1965 | Manning, Jr. et al. | 425/464 |
| 3,391,657 | 7/1968 | Reese | 425/461 |
| 3,834,251 | 9/1974 | Hawkins | 76/107 S |
| 3,893,796 | 7/1975 | Korostoff et al. | 425/461 |
| 4,015,924 | 4/1977 | LaNieve | 425/461 |
| 4,091,065 | 5/1978 | Shah | 264/177 F |
| 4,120,625 | 10/1978 | Heckeroth | 425/71 |
| 4,376,743 | 3/1983 | Dees | 264/103 |

OTHER PUBLICATIONS

Perry, R. H. and Green, D. W. "Chemical Engineer's Handbook", pp. 2344, 2345, 6th Edition, Donnelley & Son Co. (1984).

*Primary Examiner*—Khanh P. Nguyen

[57] ABSTRACT

A spinneret made from a hardened metal plate having one or more slot shaped capillaries exiting the face of the spinneret. The walls of the capillaries taper toward the face of the spinneret, and each capillary has a length to width ratio of greater than about 2.

2 Claims, 1 Drawing Sheet

SPINNERET CAPILLARIES

BACKGROUND OF THE INVENTION

This application is a continuation-in-part of application Ser. No 07/430,944 filed Nov. 2, 1989 now abandoned which in turn is a continuation of application Ser. No. 07/273,069 filed Nov. 18, 1988 and is now abandoned.

This invention relates to spinneret capillaries used for melt spinning fibers having modified cross sections such as trilobal, tetralobal, hexalobal, octalobal or fibers having internal voids, and more particularly it relates to spinneret capillaries having a length to width ratio greater than 2.

Spinnerets are usually round or rectangular metal plates typically 10 to 20 mm thick. Lead holes are drilled from the back to within several hundred u of the spinneret face. The spinneret capillaries themselves are then formed by one of several methods.

Spinneret capillaries used for solution spinning and for melt spinning round fibers are always drilled using spade drills. The most common method used for making spinneret orifices for melt spinning non-round or void-containing fibers is Electric Discharge Machining or EDM. Two methods are in use. In one, an electrode is fabricated which has the exact shape of the desired capillaries. The spinneret and the electrode are immersed in a non-conducting oil and a strong current is passed between them which erodes the metal so that an orifice of the desired shape is formed. In the other, a round hole is drilled, a wire is threaded through the hole, the spinneret is submerged in deionized water, and a strong current is passed between the wire and the spinneret. The wire is then used like a jig saw to cut out an orifice of the desired shape. Spinneret capillaries made this way of necessity have straight sides.

Another method known to Applicant is punching the orifices. In this method a first punch with sides tapered with typically an included angle of 50 degrees is used to punch an entrance channel to within typically about 100 u of the spinneret face. After lapping the face of the spinneret to remove the metal bulges produced in the first step, a second punch having the exact shape of the desired capillary is then used to form the spinning capillary. A final lapping step completes the process.

Although the second punch which forms the spinning capillary could in principle be given any desired shape, all punches made so far have straight sides; therefore, the capillaries punched with them have parallel walls. Making the punches for a spinneret capillary such as the one shown in FIGS. 1 and 2 is a very difficult task which can only be performed by very skilled mechanics after years of training. Therefore, Applicant has never attempted to make more complicated punches such as ones with tapered sides. The punching method is faster and cheaper than either of the EDM methods. However, it suffers from a major limitation: the ratio of the length of the capillary to the width at the narrowest point, hereinafter referred to as L/D, is limited by the strength of the punch to values somewhat less than 2. Typically, the length of the capillary will be of the order of 100 u and the width of the slots will be of the order of 60–80 u, so L/D will be about 1.2 to 1.7.

In melt spinning of fibers such as nylon, polyester, or polypropylene, one desires capillaries with high L/D primarily for two reasons: mechanical soundness of the spinneret and polymer metering. However, at very high L/D, pressure drop becomes a problem since polymer leaks from the spinning pack become more frequent as the pressure drop increases. A third advantage for high L/D comes into play with post coalescing spinnerets such as the one shown in FIG. 1. At low L/D the webs between the slots are weak and are often ripped out when the spinneret is removed from the spinning machine and the polymer cools and contracts. This imposes a minimum width on the web but for good post coalescence one would like to decrease the web width. Obviously, if the web thickness is increased, the web width can be decreased without jeopardizing mechanical soundness.

The ideal spinneret would have complete capillary-to-capillary uniformity, as well as uniformity along the length of the capillary. Each capillary would have a length to width ratio of at least 2 or more for adequate mechanical soundness and accurate polymer metering. The holes would be as small as practical to impart a high velocity, hereinafter referred to as the jet velocity, to the emerging polymer stream. A high jet velocity is desired to minimize the spin stretch, the ratio of the feed wheel velocity to the jet velocity, and it is essential for good post coalescence. Excessive spin stretch results in denier non-uniformities and can result in spinning discontinuities. Further, the spinneret would operate at low pressures (e.g. at less than 14,000 kPa) to reduce pack leaks and pumping requirements. Unfortunately, the requirement for good metering (small, straight-sided holes with long length-to-width dimensions) conflicts with low pressure operation.

SUMMARY OF THE INVENTION

The invention significantly reduces the pressure drop through the capillary while retaining mechanical soundness and excellent metering by tapering the capillary in the direction of polymer flow through the spinneret. More particularly, the spinneret comprises a metal plate having upper and lower surfaces connected by one or more passages. The passages exit the lower surface of the plate in a capillary length having a length to width ratio greater than 2, with sidewalls that taper toward the lower surface of the plate at an included angle greater than about 3 degrees and preferably between 3 and about 20 degrees.

DETAILED DESCRIPTION OF A PREFERRED EMBODIMENT

While this invention can produce any of a great number of complex slot type spinneret capillaries, it is described hereinafter with reference to one particular form. It is to be understood, however, that the invention is in no way limited to the particular form of capillary illustrated.

Figure 1:
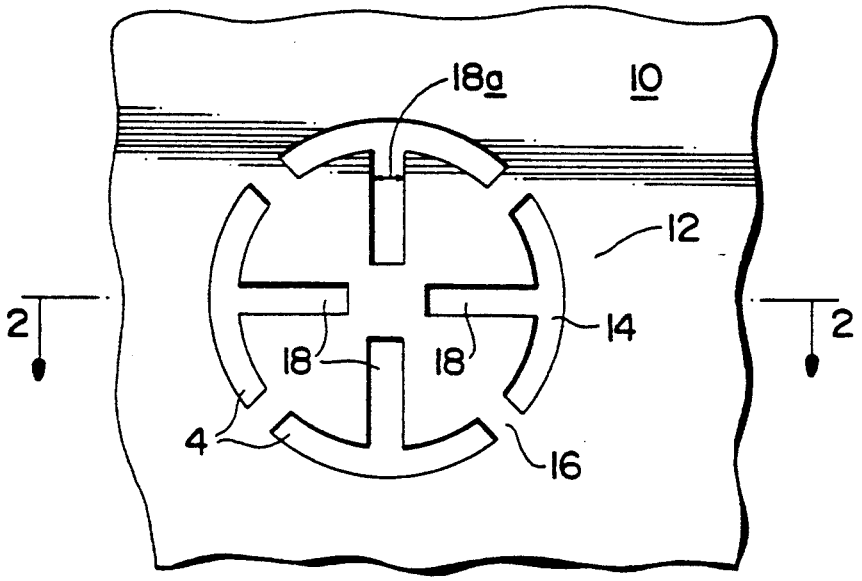
FIG. 1 is a plan view of the exit face of a spinneret capillary.

FIG. 1 is a plan view of the portion of the exit face of a spinneret plate 10 having one complex slot type spinneret capillary 12. Ordinarily, finished spinneret plates have from several to a multiplicity of capillaries identical to the one shown. As is apparent, "spinneret capillary" as herein defined is a complex arrangement of slot type openings together providing for the extrusion of one filament. The capillary 12 comprises four peripheral slot type openings 14 generally surrounding an inner minute area. Extending radially inward short of a common intersection are four straight slot type openings 18 each joining the peripheral openings 14 at their centers. Air vents 16, coextensive with the surrounding spinneret plate 10, separate peripheral openings 14. Preferably, the peripheral width of air vents 16 is less than the radial width of each opening 14.

During extrusion of, e.g. a molten polymer through capillary 12, four T-shaped streams are formed at and immediately downstream of the exit face of spinneret plate 10. Adjacent ends of the T-shaped streams then coalesce to form a continuous integral filament having four uniform voids extending continuously therealong. Air vents 16 allow entrance of air into the voids before coalescence, thus preventing the collapse of the filament due to the internal vacuum which otherwise would result.

Figure 2:
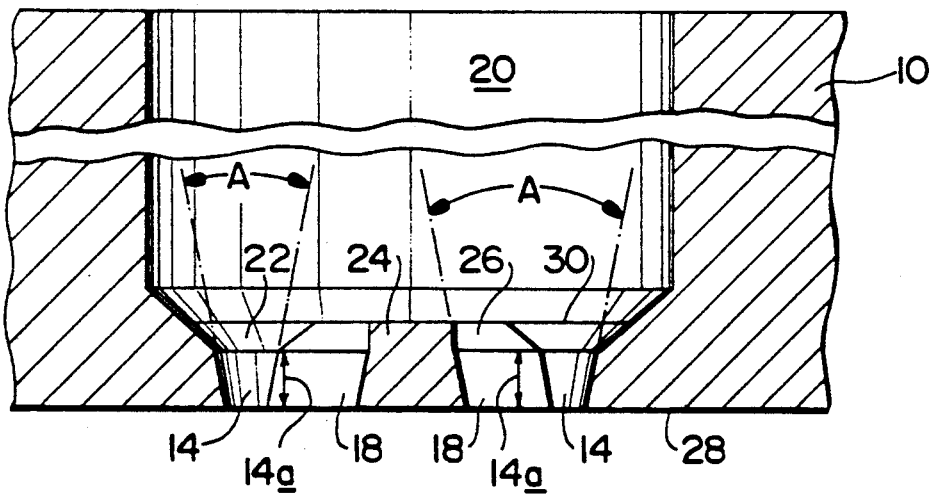
FIG. 2 is a cross sectional view of FIG. 1 taken along line 2—2.

In FIG. 2 peripheral openings 14 are shown at exit face 28 leading to their entrance channels 22. Likewise shown are radial openings 18 with entrance channels 26 separated by unmachined area 24. Spinneret plate 10 is ordinarily much thicker than the thickness between entrance of the capillary and exit face 28. Before machining the capillary, larger counterbore 20 with flat entrance face 30 is machined into plate 10 at each location where a spinneret capillary is to be formed. The ratio of length 14*a* of the capillary to the width 18*a* of the capillary slot is preferably greater than 2 and the sidewalls of the capillary slots are tapered in the direction of the lower surface 28 of the spinneret plate 10 at an included angle A which preferably is in the range of from about 3 to about 20 degrees.

By way of providing a scale to desirable spinneret capillaries, the slots 14 and 18 preferably are between about 0.05 mm and 0.130 mm in width (18*a*) and between about 0.40 mm and 1.0 mm in length (14*a*).

The capillaries are made by cutting the holes with a laser beam (150 watt pulsed Nd YAG Laser by LASAG).

The spinneret capillary shown in FIGS. 1 and 2 is exemplary of the variety of complicated capillaries which can utilize the principles of this invention.

What is claimed is:

1. A spinneret comprising a metal plate having upper and lower surfaces connected by a passage, said passage exiting said lower surface in a capillary length having a slotted configuration defined by a continuous straight sidewall upstanding with respect to said lower surface, said sidewall having directly opposed portions that taper to said lower surface at an included angle of greater than about 3 degrees, said capillary length having a length of between 0.40 mm and 1.0 mm and a width of between 0.050 mm and 0.130 mm.

2. The spinneret of claim 1 wherein said included angle is between about 3 and about 20 degrees.

* * * * *